United States Patent [19]

Hirth et al.

[11] Patent Number: 4,986,347

[45] Date of Patent: Jan. 22, 1991

[54] SCRAPER

[75] Inventors: Michael Hirth, Mellingen; Joachim Jochum; Christian Wieckert, both of Baden, all of Switzerland

[73] Assignee: Asea Brown Boveri Ltd., Baden, Switzerland

[21] Appl. No.: 358,621

[22] Filed: May 30, 1989

[30] Foreign Application Priority Data

May 27, 1988 [CH] Switzerland ..... 2034/88

[51] Int. Cl.[5] ..... B22B 19/14; F28G 3/10

[52] U.S. Cl. ..... 165/94; 110/165 R

[58] Field of Search ..... 30/169; 15/162, 163, 15/236.2, 236.3; 98/58; 110/165 R, 184; 122/155 A, 44 A; 165/94

[56] References Cited

U.S. PATENT DOCUMENTS 1,690,434 11/1928 Rockelman .
3,410,335 11/1968 Malmstrom et al. ..... 165/94 X
4,315,541 2/1982 Murata et al. ..... 165/94

FOREIGN PATENT DOCUMENTS 46485 9/1888 Fed. Rep. of Germany .
397.008 11/1908 France .
52-129714 11/1978 Japan .
61-29699 10/1986 Japan .
2030672 9/1979 United Kingdom .

OTHER PUBLICATIONS

FIG. 4 on p. 382 of Chem.-Ing.-Tech. 54, Nr. 4 (1982).
Patent Cooperation Treaty—International-Type Search Report.

*Primary Examiner*—Douglas D. Watts
*Attorney, Agent, or Firm*—Burns, Doane, Swecker & Mathis

[57] ABSTRACT

An apparatus for the removal of residues from the inner wall of a tube carrying hot gases and/or vapors includes a passage extending into a first end of the tube in an axial direction; an axially extending shaft supported within the passage in an axially displaceable manner so that one end of the shaft is within the tube; a discharge opening in the tube through which the residues may be removed; a helically wound metal scraper connected to the one end of the shaft; and a device for driving the shaft such that the scraper is rotated in a manner of a corkscrew into the tube.

14 Claims, 2 Drawing Sheets

SCRAPER

BACKGROUND OF THE INVENTION

1. Field of the Invention

The invention relates to an apparatus for the removal of residues deposited on the inner wall of a pipe carrying hot gases and/or vapors.

2. Description of Related Art

An apparatus of the above-mentioned type is disclosed in Chem.-Ing.-Techn., Vol. 54, 1982, p. 382, FIG. 4. The disclosed apparatus comprises a driven shaft carrying different axially extending scraping devices for scraping off residues deposited on an inner wall, when moved radially. Both the center shaft and the scraper devices remain stationary inside the apparatus and are constantly exposed to the hot gases and/or vapors flowing through this internal space. The apparatus can therefore only be used within a temperature range of up to about 100° C., as at higher temperatures the scraper devices would melt and would no longer be able to perform their function. The use of more temperature resistant materials, such as ceramics, for the scraper devices, in order to attain higher operating temperatures is not practical, as these materials have low mechanical strengths and are very difficult and expensive to use.

SUMMARY OF THE INVENTION

The invention is intended to eliminate the disadvantages of the prior art. In particular, the invention provides an apparatus from which by simple means, residues may be removed from areas exposed to temperatures in excess of 1300° C.

The apparatus for the removal of residues from the inner wall of a tube carrying hot gases and/or vapors includes a passage extending into a first end of the tube in an axial direction; an axially extending shaft supported within the passage in an axially displaceable manner so that one end of the shaft is within the tube; a discharge opening in the tube through which the residues may be removed; a helically wound metal scraper connected to the one end of the shaft; and a device for driving the shaft such that the scraper is rotated in a manner of a corkscrew into the tube.

As a result of the invention, known materials, for example steel, which are relatively simple to use, may be utilized for the scraper device. The scraper device is exposed to high temperatures periodically, and only for periods short enough so that it will not be appreciably heated and will therefore not lose its mechanical strength. The temperature range in which this device is used may therefore be increased to more than 1300° C.

The invention, its development and the advantages obtained by it, will become more apparent from the description below, with reference to the drawing, which merely represents one mode of embodiment.

DETAILED DESCRIPTION OF PREFERRED EMBODIMENTS

Figure 1:
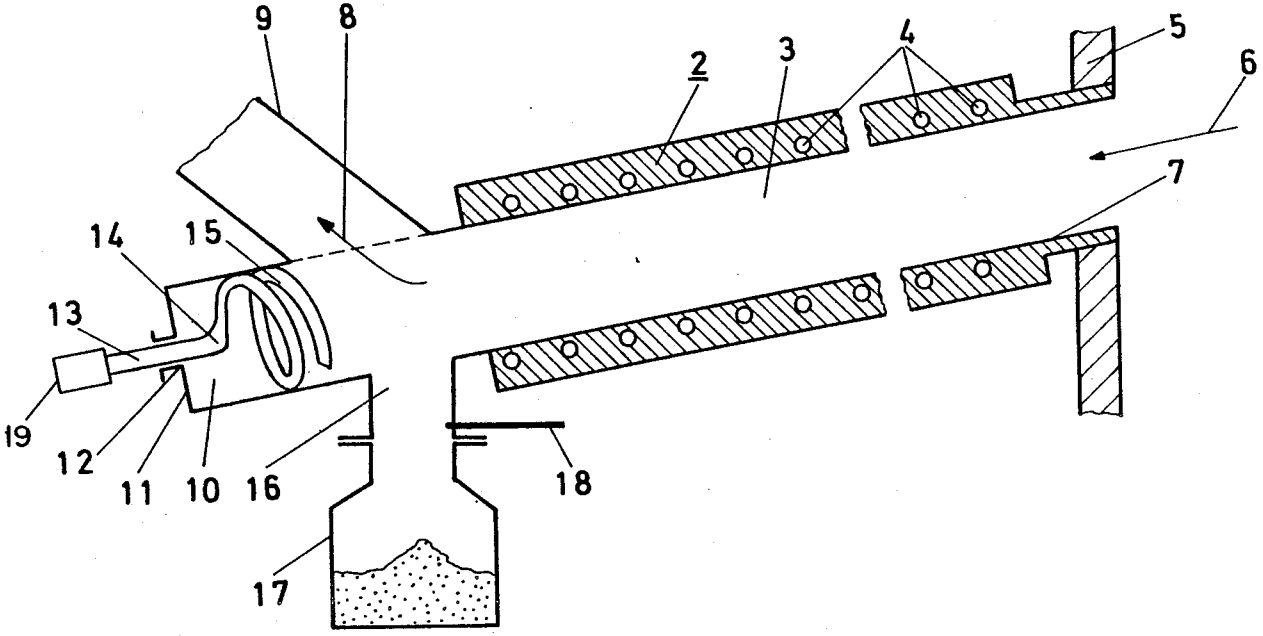
FIG. 1 is a view of a first embodiment of an apparatus according to the present invention.

With reference to FIG. 1, a cooler 2 of a ceramic material, with a cylindrical inner space 3 and cooling tubes 4 set into the wall, is flanged onto an opening in the outer wall 5 of a furnace. Arrow 6 indicates the direction of flow of hot gases and/or vapors exiting from the furnace, and which are cooled in the cooler 2. In the course of this cooling process, components of the hot gases and/or vapors are condensed or desublimed and deposited onto the inner wall 7 of the cooler 2. The cooled gases leave the cooler 2, as indicated by arrow 8, through a flanged fitting 9.

On the side of the cooler 2 opposite the furnace, a cylindrical cavity 10 is provided in the axial extension of the cooler, the diameter of the cavity 10 being the same as the diameter of the cooler 2. The cavity 10 is closed off bY a frontal wall 11. The walls of this cavity 10 may be made of steel, for example, while a ceramic liner is not required here in view of the lower temperatures. In the center of the frontal wall 11, a passage 12 is provided for a rotating, axially mounted shaft 13. The passage 12 serves to guide the shaft 13. At the tip 14 of the axially mounted shaft 13, a metal part, or scraper, 15 is provided. The metal part 15 is wound helically in the axial direction with, for example, 1½ turns. This dimensionally stable metal part 15 forms the scraper device proper of the apparatus.

Located between the rest position of the scrape device as shown in the figure, and the part of the cooler 2 that is equipped with the cooling tubes 4, a discharge opening 16 is provided at the lowest part of the cooler 2. A collecting vessel 17 is flanged to the discharge opening 16. When changing the collecting vessel 17, the discharge opening 16 may be closed by means of a slide 18.

The operation of the apparatus will now be explained. In the cooler 2, the hot gases and/or vapors entering from the furnace at more than 1300° C. are cooled. During the cooling process certain residues are condensed or desublimed and are deposited on the cooled inner wall 7 of the cooler 2. Those residues may consist of raw material produced in metallurgical works, but they may also be harmful substances removed from contaminated gas-vapor mixtures. The cooler 2 may further include a structural group, and the ability of that group to operate may be affected by those residues.

To remove the residues, the axially extending shaft 13 is rotated by a drive 19, shown schematically, and is simultaneously displaced in the axial direction. The advancement and the rotating velocity of the shaft are correlated with the pitch of the windings of the metal part 15, so that the latter is moved in the tubular inner space 3 of the cooler 2 in the manner of a screw against the direction of flow indicated by the arrow 6. The free flow cross section of the cooler 2 is decreased only negligibly. When the helical motion through the zone of the residues deposited on the inner wall 7 is completed, the metal part 15 is retracted by the shaft 13 into its rest position, whereby it scrapes the residues from the inner wall 7 and transports them to the discharge opening 16. By means of this motion, when residues are scraped form the inner wall 7 they are prevented from moving toward the hot zone of the cooler 2 on the furnace side, where they could again be melted or evaporated. This movement from the rest position of the scraping device into the hot zone and back into the rest position in the cooler zone of the tube takes place over a relatively short period of time, so that the metal part 15 is not heated to the predetermined limiting temperature for its application. The motion is repeated periodically.

In the course of the retraction of the metal part 15, the rotating motion may be retained in the direction of the forward screwing motion, if a particularly effective scraping action is desired. It is advantageous to provide the edge of the metal part 15 which is engaged during the scraping process in the form of a finely ground scraper blade.

In the case of certain residues, it may be appropriate to harden the scraping edges.

The metal part 15 may be of a shape exactly fitting into the cylindrical inner space 3, or it may also be sized slightly larger than the inner diameter of the tube 2 and provided with an elastic configuration that enables it to press elastically against the inner wall 7. It is possible in this manner to scrape off even hard backed residues and to transport them into the collecting vessel 17.

Between the metal part 15 and the inner wall 7, a gap with a width of, for example 0.5 mm, may be provided, with the result that there will always be a corresponding layer of residue covering the inner wall 7. Such an embodiment has the advantage that the inner wall 7 is protected against corrosion if corrosive gases and/or vapors are cooled.

The metal part 15 is not exposed in its rest position to elevated temperatures and therefore does not lose its internal mechanical strength and shape retention. Instead, the metal part 15 stays at approximately the temperature prevailing in the area of the fitting 9, which forms the outlet of the cooler 2. At the beginning of the metal part 15, when it is in the rest position, there is therefore no danger of thermal shock when the ceramic part of the cooler is contacted by the metal part 15 of the cooler 2.

A prototype of an apparatus has been operated successfully. In the prototype, the cooler 2 is a 1 m long ceramic tube with embedded cooling tubes 4 for water cooling. The ceramic tube has an internal diameter of 10 cm. The metal part 15 consists of a helical spring with a constant pitch, and is appropriately ground on the outside, with one and one-half turns of the spring. The axially extending shaft 13, to which the tip of the metal part 15 is connected, is made of steel and has a diameter of about 10 mm.

A gaseous mixture was fed into the cooler 2 from a furnace at a temperature of approximately 1300° C. under normal pressure. This gaseous mixture contained 95% air, 2% gaseous heavy metal compounds, primarily $ZnCl_2$, PbO, $PbCL_2$, etc. and 3% other components, such as $CO_2$, $SO_2$, etc. The heavy metal compounds were deposited on the inner wall 7 of the cooler 2 and were discharged in a powder form for further processing.

The apparatus may also, as in the above case, be made gas tight, if harmful gases and/or vapors are to be cooled, and it is further possible to operate it at an overpressure or at a reduced pressure. In such cases, the passage 12, the flanged joint between the discharge opening 16 and the collecting vessel 17, the slide 18, and the transition between the outer wall 5 of the furnace and the cooler 2 must be gas tight and possibly also pressure tight.

Figure 2:
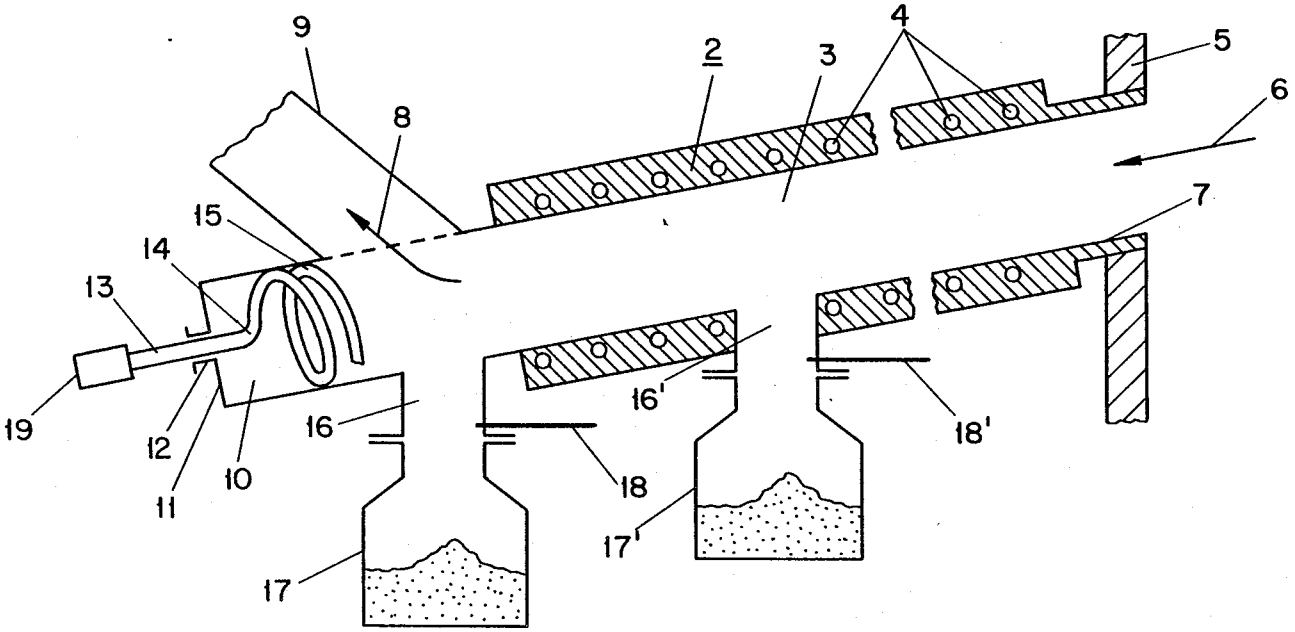
FIG. 2 is a view of a second embodiment of an apparatus according to the present invention.

The cooler 5 is preferably inclined downward in the direction of the discharge opening 16. This slope facilitates the discharge of the residues scraped off and prevents the flowing back into the furnace of any material condensing in liquid form. Inside the cooler 2 different temperature zones are formed and it is conceivable that in a certain temperature zone a certain fraction of the residues is deposited in a particularly highly concentrated manner. This fraction can be removed only through an additional discharge opening 16', which is shown in the embodiment of FIG. 2 and which, like the discharge opening 16, includes a collecting vessel 17 and a slide 18. The further processing of such residues is simplified by this fractionally separated discharge.

It is also conceivable to use such an apparatus in layouts through which hot liquids are flowing, in order to free critical areas of deposits which would detrimentally narrow the flow cross section.

Although only preferred embodiments are specifically illustrated and described herein, it will be appreciated that many modifications and variations of the present invention are possible in light of the above teachings and within the purview of the appended claims without departing from the spirit and intended scope of the invention.

What is claimed is:

1. A tube carrying hot gases and/or vapors, and including an apparatus for the removal of residues from the inner wall of said tube, comprising:

a passage extending into a first end of said tube in an axial direction;

an axially extending shaft supported within said passage in an axially displaceable manner so that one end of said shaft is within said tube;

a discharge opening in said tube through which the residues may be removed;

a helically wound metal scraper connected to said one end of said shaft; and means for driving said shaft such that said scraper is rotated in a corkscrew manner into said tube.

2. The tube of claim 1, wherein the scraper is comprised of an elastic material so that it presses elastically against said inner wall of said tube.

3. The tube of claim 1, wherein an outer diameter of said scraper is smaller than an inner diameter of said tube such that there is a gap between said inner wall and said scraper.

4. The tube of claim 1, wherein said scraper includes at least one full winding turn.

5. The tube of claim 1, further comprising a cavity at an end of said tube opposite said first end of said tube.

6. The tube of claim 1, wherein said scraper is wound with a constant pitch.

7. The tube of claim 1, wherein said discharge opening is located at a lower end of said tube.

8. The tube of claim 1, wherein said tube is made of a ceramic material having cooling tubes embedded therein.

9. The tube of claim 1, wherein said tube includes an opening for the hot gases and/or vapors at an end of said tube opposite said first end of said tube.

10. The tube of claim 7, wherein the tube includes an opening at an end of said tube opposite said lower end of said tube through which opening the hot gases and/or vapors enter said tube.

11. The tube of claim 1, wherein said tube is gas tight and may be operated at an overpressure.

12. The tube of claim 1, wherein said tube is gas tight and may be operated at a reduced pressure.

13. A tube carrying hot gases and/or vapors, and including an apparatus for the removal of residues from the inner wall of said tube, comprising:

a passage extending into a first end of said tube in an axial direction;

an axially extending shaft supported within said passage in an axially displaceable manner so that one end of said shaft is within said tube;

a discharge opening in said tube through which the residues may be removed;

a helically wound metal scraper connected to said one end of said shaft;

means for driving said shaft such that said scraper is rotated in a corkscrew manner into said tube; and a cavity at an end of said tube opposite said first end of said tube, whereby when said scraper and said shaft are in a rest position, said scraper fits within said cavity so that it is not exposed to the hot gases and/or vapors within said tube.

14. A tube carrying hot gases and/or vapors, and including an apparatus for the removal of residues from the inner wall of said tube, comprising:

a passage extending into a first end of said tube in an axial direction;

an axially extending shaft supported within said passage in an axially displaceable manner so that one end of said shaft is within said tube;

a discharge opening in said tube through which the residues may be removed;

a helically wound metal scraper connected to said one end of said shaft;

means for driving said shaft such that said scraper is rotated in a corkscrew manner into said tube; and a second discharge opening in said tube offset in said axial direction.

* * * * *